United States Patent [19]

Downing

[11] 4,259,764

[45] Apr. 7, 1981

[54] APPARATUS FOR THE FOAMED ACID DELINTING OF COTTONSEED

[75] Inventor: James D. Downing, Scott, Miss.

[73] Assignee: Delinting Systems, Inc., Memphis, Tenn.

[21] Appl. No.: 10,488

[22] Filed: Feb. 8, 1979

[51] Int. Cl.[3] ..... D01B 1/04; F26B 19/00

[52] U.S. Cl. ..... 19/41; 47/58; 47/DIG. 9

[58] Field of Search ..... 19/40, 44, 45, 46, 47, 19/41; 34/60, 61; 47/58, DIG. 9; 134/28, 30

[56] References Cited

U.S. PATENT DOCUMENTS

| | | | |
|---|---|---|---|
| 80,593 | 8/1968 | Brown | 19/40 X |
| 299,378 | 5/1884 | Green | 19/40 |
| 307,190 | 10/1884 | Green | 19/40 |
| 310,628 | 1/1885 | Wall | 19/40 X |
| 340,635 | 4/1886 | Stead | 19/40 X |
| 344,951 | 7/1886 | Dudley et al. | 19/40 X |
| 354,109 | 12/1886 | Dubley | 19/40 |
| 2,646,268 | 7/1953 | Jackson | 19/40 |
| 4,064,636 | 12/1977 | Downing | 19/40 X |
| 4,154,021 | 5/1979 | Griffith et al. | 47/58 |
| 4,203,254 | 5/1980 | Downing | 47/58 |
| 4,216,616 | 8/1980 | Smith | 47/58 |

FOREIGN PATENT DOCUMENTS

| | | | |
|---|---|---|---|
| 30859 | 2/1889 | Canada | 19/40 |

*Primary Examiner*—Louis Rimrodt

*Attorney, Agent, or Firm*—LeBlanc, Nolan, Shur & Nies

[57] ABSTRACT

Apparatus and method for delinting cottonseed wherein a moving body of cottonseed is subjected to a flame treatment for burning off excess linters, then subjected to an acid treatment wherein foamed sulfuric acid of adequate water content is deposited on the seed and the seed agitated, and then the seed is dried and the acid degraded linters removed. In an important embodiment the seed is acid treated, dried and buffed to remove degraded linters serially in at least two successive stages.

10 Claims, 9 Drawing Figures

FIG. 6
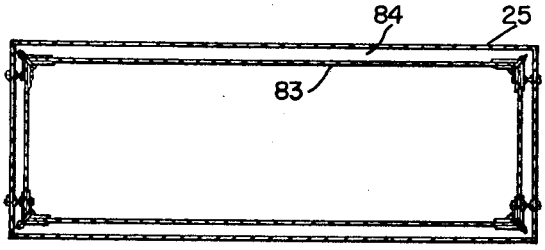
FIG. 7
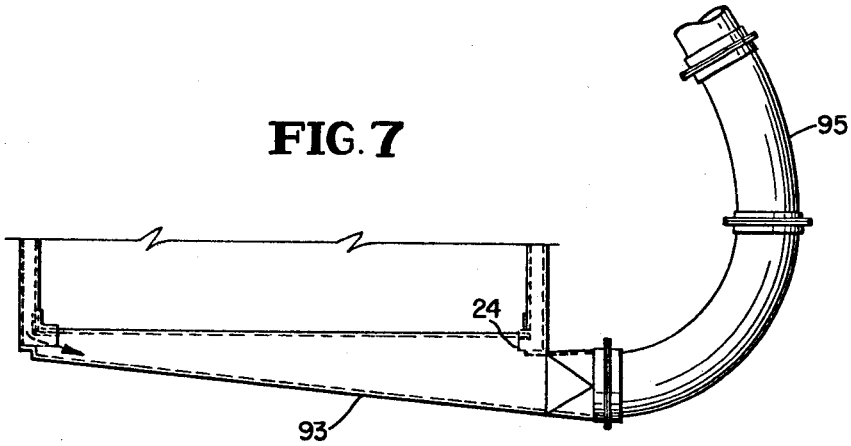
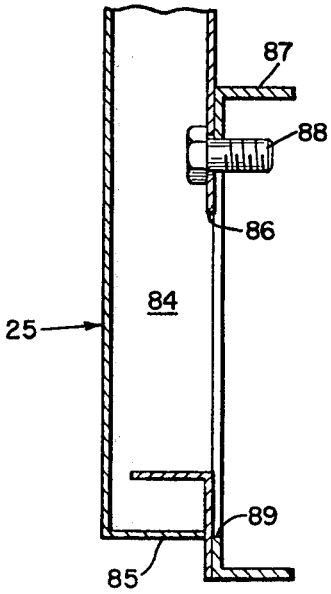
FIG. 8

APPARATUS FOR THE FOAMED ACID DELINTING OF COTTONSEED

This invention relates to the delinting of cottonseed, particularly cottonseed that has emerged from the cotton gin, and is particularly concerned with a novel apparatus and method whereby the cottonseed is cleaned of linters in associated precleaning and acid treatment operations.

In its preferred embodiment the invention is concerned with novel apparatus and method for acid delinting of cottonseed, wherein foamed sulfuric acid is applied in a novel manner to the cottonseed to be delinted, and this is a major object of the invention. It has been found that foam is a more efficient carrier for the acid than water dilution previously relied upon and that more uniform distribution and action of foamed acid may be obtained upon controlled agitation of the mass of seed to be delinted.

The acid delinting of cottonseed has long been practiced. It is known to spray or similarly deposit liquid sulfuric acid in varying concentrations upon the cottonseed to be delinted, and then dry the seed and remove the linters, which as cellulose are rapidly degraded when they absorb the acid. In most cases it is important not to damage the seed hull but at the same time remove linters, which may be in the neighborhood of ⅛" to ¼" long and even longer in tufts and are so firmly attached to the hull that prior mechanical efforts at delinting have proved unsatisfactory. Removal of linters from cottonseed destined for planting for example is especially important in that seed coated with the linters may ball up and choke automatic seed planters. Some planters however prefer partially delinted seed for various reasons and this is attainable in the invention.

The most pertinent prior art known is that disclosed in U.S. Letters Pat. to Downing No. 4,064,636 including the art cited by the Patent Office therein, principally Green U.S. Pat. Nos. 299,378 and 307,190 and Canadian Pat. No. 30,859 published February, 1889.

Among the major problems encountered in the art have been the time and expense of drying the acid treated seed, chiefly due to the large amounts of water employed to dilute the sulfuric acid and the corresponding energy input required to remove the water in drying the treated seed. Also initially the uncleaned seed mass may contain large amounts of impurities such as branches, leaves and weed fragments much of it due to the machine picking of cotton, leading to increased problems in cleaning.

In practice the present invention constitutes improvement over said Downing patent apparatus, particularly in that the sulfuric acid is controllably applied to seed in a foamed condition, preferably after an introduced precleaning operation wherein major impurities are removed and bulky, excessively long and tufted linters are at least partially removed as by combustion, and this is an important object of invention.

In Downing for example dilute liquid sulfuric acid is applied to agitated cottonseed to be delinted. While this has proved generally satisfactory it takes some time for the liquid acid to distribute uniformly and saturate the linters and complete degradation. The invention has as an important object the speeding up of this phase of operation and this is accomplished by applying the sulfuric acid in foamed condition. By using foamed acid it has been found possible to use more highly concentrated sulfuric acid which means that less water has to be removed in the final drying stages. Major benefits of the reduced drying time are reduced energy consumption and simplification of the drying equipment.

It is an important object of the invention to accomplish acid treatment, drying and scrubbing for removal of degraded linters serially in at least two successive similar stages, the apparatus for carrying this out being preferably provided with a bypass arrangement whereby for example the output from the first stage may be diverted directly to final handling, as wherr only partially delinted seeds are desired.

It has been observed that some batches of ginned cottonseed exhibit rather long and sometimes excessive and even tufted fibers that could require longer times to become saturated, and it is an important object of the invention to introduce just prior to acid treatment a seed precleaning or preconditioned operation, preferably one in which the cottonseed is passed through a flame zone where the branches, leaves and weed fragments are burned and the excessive fibrous linters are ignited and at least partially burned off.

A surprising result of controlled foamed acid treatment, and particularly when used in a continual one or multiple stage process together with flame precleaning, has been that overall materially less energy is required to complete the process.

It is an object of the invention to provide a novel cottonseed delinting method and apparatus wherein foamed sulfuric acid of controlled predetermined water content is deposited upon a moving agitated bed, column or like mass of cottonseed to be delinted.

Another object of the invention resides in novel arrangements and controls for selectively apportioning sulfuric acid, a foaming agent, air and sometimes water and mixing them so as to produce foamed acid to be continually deposited upon a moving bed of seed for optimum linters removal.

Further objects of this invention will appear as the description proceeds in connection with the appended claims and below described drawings.

BRIEF DESCRIPTION OF DRAWINGS

FIG. 6 is a section substantially on line 6—6 of FIG. 3 showing the double wall structure;

FIG. 7 is a fragmentary view showing removal of cooling air from the rear side of the flame treatment stack; and FIG. 8 is a section substantially on line 8—8 of FIG. 5.

PREFERRED EMBODIMENTS

Figure 1:
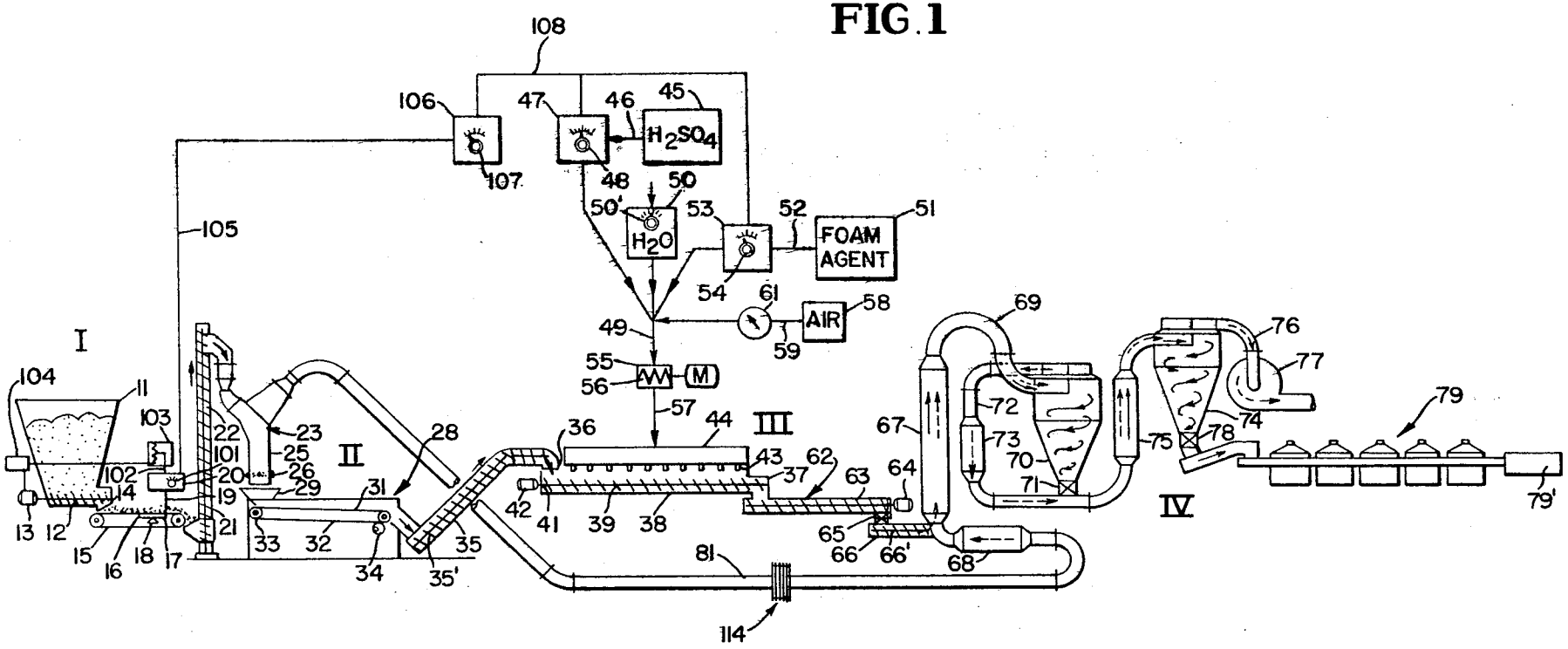
FIG. 1 is a relatively diagrammatic view showing apparatus in an important embodiment of the invention.

Referring to FIG. 1 the apparatus comprises a supply and seed input I where the seed to be delinted is introduced and fed continually in a predetermined manner to a precleaning section II. After precleaning the seed is fed to an acid treatment section III and then to a buffing and drying section IV. As will appear the acid treatment and drying operations may be repeated in succession in two or more stages prior to neutralization and other final handling.

Supplies of the seed to be cleaned of its surface fibers are deposited in a hopper or bin 11. The seed may or may not have been predried and/or predried to a desired moisture content. Bin 11 is preferably of the live bottom type wherein one or more feed screws 12 at the bottom are driven as by an electric motor 13 to assure a controlled metered delivery of the seed into the apparatus. Bin 11 may be of any suitable type, and for example may be like that disclosed in said Donwing U.S. Pat. No. 4,064,636.

The speed of motor 13 determines the rate of feed or seed to the apparatus, and thus seed to be cleaned is constantly discharged from the bin at a controlled rate through outlet 14 onto the top flight of an endless conveyor belt 15 that is driven at a constant speed by a motor (not shown). There is thus deposited on belt 15 a continuously moving uniform cross section horizontal column of seed to be handled and processed.

As shown, a portion of the belt bearing the seed is passed over a weight scale platform 16 that is connected to a balance lever 17 pivoted on a fulcrum 18 and connected by arm 19 to a control unit 20 for a purpose to appear.

The foregoing weigh system thus continuously measures the weight of a predetermined volume of the seed passing thereover, and so continuously measures the weight rate of flow of the seed into the treatment sections of the apparatus, and it may be the same as disclosed in said Downing patent.

The invention contemplates any equivalent system that will provide continuous supply of seed to the precleaner section.

The column of seed leaving the end of the belt 15 is delivered to precleaning section II at the lower end of the lift structure 21 that contains an elevator in the form of a vertical conveyor 22 which raises the seed column to the upper end of a flame treatment device indicated at 23.

This flame treatment device, which is shown in more detail in FIGS. 3–8, comprises an entrance roller 24 that has on its surface a plurality of spiral rows of projecting teeth or spikes 24' and rotates on a horizontal axis. Roller 24 extends across a housing of corresponding shape so that it occupies the mouth of the housing and thereby is encountered by substantially all of the entering seed. Roller 24 is rotated continuously by a motor assembly indicated at M and the motor speed may be varied. Below roller 24 is a generally vertical open bottom fireproof stack 25 that has on opposite sides gas burners 26 projecting flame into and across the interior of the passage defined by the stack to form a fire curtain through which the descending seeds freely fall after leaving the roller. Roller 24 tends to separate the seeds, and propel them down the stack while distributing them uniformly across the passage. Thus all seeds are uniformly flame treated.

Roller 24 is preferably supported in opposite end bearings in the generally rectangular housing and of such size to effectively handle the seed being introduced. In a working example the roller is about twelve inches in diameter and forty-eight inches long rotating at 200 rpm. The spiral arrangement of the spikes has been found to be peculiarly effective.

At its upper end and below roller 24, stack 25 has a hood 27 whereby suction may be applied as indicated so that air may be drawn up through the stack passage in countercurrent relation to the falling seed, and heated air and the products of combustion exit at hood 27 to be drawn away by a suction fan connected conduit.

Further detail of this flame treatment device will be described in connection with FIGS. 3–8.

The precleaning section II may also include a vibrating screen assembly 28 having an input end 29 through which the flame treated seeds drop onto and through a vibrating horizontal screen assembly, shown by way of example as two different level screens 31 and 32 having apertures only large enough to pass seeds vibrated back and forth as by eccentrics 33 and 34, and the seeds emerging frm this unit enter the lower end of a chute 35 containing a screw conveyor 35' leading to the acid treatment section. In the vibrating screen assembly undesired seeds and burned, partially burned and unburned fragments of impurities such as branches, leaves, ashes, etc. are removed, and the precleaned seeds are moved as a column up a continuously moving conveyor to a discharge point 36 at the entrance of the acid treatment section III.

The seeds discharged at 36 drop into a seed treatment section comprising a housing 37 having a lower horizontal trough 38 in which is disposed a conveyor-agitator 39 that agitates the seed while feeding the seed mass to the right in FIG. 1. The shaft 41 of conveyor-agitator 39 is driven by an electric motor 42, as described in said Downing patent.

During passage of the seed along trough 38 foamed sulfuric acid is simultaneously deposited over a predetermined length of the horizontal column in trough 38. A series of horizontally spaced nozzles 43 are provided in housing 37 above the level of the moving agitated seed mass, so that a predetermined length of the column of agitated seed is thoroughly uniformly treated during passage. Preferably nozzles 43 are not of the spray type. As will appear the amount of foamed acid deposited onto the seed is so regulated that all of the acid is absorbed in the fibers or is on the surfaces of the fibers and during operation there is no accumulation of liquid dilute acid in trough 38.

During passage through the trough, the seed is uniformly treated, this being assured by the continuous agitation and the maintained deposit of foamed acid.

This structure except for that of the nozzles 43 may be generally the same as disclosed in said Downing patent. Nozzles 43 are connected to a common manifold 44.

It has been found in the invention that, as compared to the liquid sulfuric acid treatment of Downing, the agitator 39 may be run more slowly while the length of the moving bed being treated in trough 38 may be shorter, thereby conserving energy while at the same time obtaining good distribution of the foam in the moving seed mass.

In this embodiment from trough 38 drops into and passes along a mixer 62 wherein the seed mass is a moving bed conveyed and agitated by a conveyor-agitator 63 driven by motor 64. The seed from mixer 62 enters the drying section III through a rotary air lock valve 65.

Sulfuric acid of suitable concentration may be supplied from a source indicated at 45 along a conduit 46 into a feed control valve device 47 which is adjustable as shown at 48 to regulate the rate of flow of acid in conduit 49. Water may be added from a source 50 having a feed valve control 50'.

In the invention for proper degradation of the cottonseed there must be deposited adequate sulfuric acid and associated water amounts per ton of seed, for best results in foamed acid delinting.

The amount of sulfuric acid ranges from a minimum of about twenty pounds of acid (100% concentration) per ton of seed to a maximum of about sixty pounds of acid (100% concentration) per ton of seed being treated. I have discovered for example that acid of 100% concentration cannot be employed because it contains no water and cannot adequately saturate the fibers.

Therefore it is necessary to include or mix water with the acid for sufficient wetting and saturation of the fibers to obtain full degradation. The amount of such water ranges from a minimum of about one hundred pounds of water per ton of seed being treated to a maximum of about three hundred pounds of water per ton of seed being treated.

Thus an optimum minimum combination would be a mixture twenty pounds of acid (100% concentration) and one hundred pounds of water per ton of seed being treated.

The amount of water may advantageously be included in the degree of concentration of the acid. For example if 25.64 pounds of sulfuric acid of a 78% concentration, which is commercially available is used, which acid would contain 22% or 5.64 pounds of water per ton of seed, it is necessary to add a minimum of only 94.36 pounds of water for the optimum combination expressed above. These ratios apply over the foregoing ranges of acid and water.

The foregoing relative proportions may not always be obtainable in practice, but they hold in general.

In practice, in order to select the proper water-acid mixture, I preferably set the acid and water flow deliveries at 48 and 50 respectively to calculated minimum values, depending upon the actual concentration of the acid at hand, and start operation. Then if the delinting is seen to be incomplete I utilize the flow controls to raise the acid content until satisfactory delinting is attained. If there is at any time carbonized black fiber residue on the treated seed, such is a sign of excess acid, and the condition may be corrected by using the flow controls for raising the water content, and/or by reducing the acid content. The degree of delinting the seed may be controlled accurately in this manner, as where only partly delinted seed is desired.

Thus the actual concentration of the acid as such is not particularly critical but the concentration must of course be large enugh to ssure adequate acid being present during treatment. In practice, I have found that about 25% and higher concentrations of sulfuric acid are preferable. There must be enough water present in the foam to assure complete fiber wetting and saturation. The invention enables the safe use of higher concentration sulfuric acids while holding the amount of included or mixed water as low as possible. The advantage of this is to lower drying energy and costs necessary to remove water to dry the treated seed.

The foaming agent which may be suitable non-ionic surfactant is introduced from a source at 51 thorugh a conduit 52 to a feed control valve device 53 that is adjustable as at 54 to control the rate of flow of foaming agent to conduit 49. The surfactant must be one that is not degraded by sulfuric acid. For example it may be an ethoxylated alcohol or a fatty amide that is preferably a reaction product of coconut fatty acid or coconut oil and diethanolamine, or mixtures of the same. The surfactant may be present in the amount of about 2–20% by weight of the acid-water surfactant mixture, preferably 3–10% where higher acid concentrations are used. While in my earlier apparatus of U.S. Pat. No. 4,064,636 I employed a small amount of surfactant as a fiber wetting agent, it was not added in sufficient quantity to be a foaming agent according to the invention. As shown in FIG. 1 conduit 49 discharges into a foaming device 55 wherein a mixing device 56 is driven by a motor M.

It has been found that the improved distribution of acid due to foam application and the slower advance of the agitated mass whereby full saturation of the fibers may take place in even a shorter trough 38 are so sufficient that in some instances the mixer section 62 may be eliminated and the wetted seed from trough 38 may be discharged directly into the dryer phase.

The drying section IV may take any suitable form for agitating seed having degraded and/or treated lint thereon and simultaneously providing heated air passing through the agitated seed to dry, provide heat for aiding the degrading reaction and removing degraded lint that has been buffed or rubbed off or otherwise separated from the seed hulls.

In a working embodiment, drying section IV comprises a conveyor duct 66 leading into the bottom of a vertical enlarged duct section chamber 67 the lower end of which is open to a heater 68 through which air is drawn into the duct system either directly, or as will appear from a source of preheated gas. Duct 66 contains a screw feeder 66' for advancing the seeds to be dried. The upper end of chamber 67 is connected by duct 69 into the upper end of a cyclone separator 70 having a bottom rotary air lock discharge valve 71 for the separated seeds. An air removal duct 72 extends from the upper end of separator 70 through an air reheat enlarged duct section chamber 73 to the bottom of separator 70 wherein it receives the seeds discharged through valve 71 and conducts them upwardly to the top of a second cyclone separator 74. A third enlarged duct chamber 75 is contained in duct 72. An air removal duct 76 leads from the upper end of separator 74 to a suction fan 77. The separated seeds falling through separator 74 are discharged through a rotary air lock valve 78 onto a conveyor that transports them through a system of fan equipped drying buffers at 79 wherein the degraded linters are physically separated from the seed, and finally a neutralizer region at 79' wherein an alkaline medium is applied to neutralize traces of acid remaining on the seed. The system of buffer/dryers and neutralizers may preferably be the same as disclosed in the Downing patent.

The turbulent tumbling mass of seeds passing up through cyclone separator 70 is subjected to an essentially flash drying operation. The air drawn out of separator 70 is reheated at 73 to restore heat loss up to that point, and the mass of seeds is again subjected to a flash drying operation when passing through heater chamber 75 and cyclone separator 74. In this manner the seeds which are conveyed in a hot air stream substantially entirely through the drying section IV are subjected to very efficient drying prior to final scrubbing at 79.

In FIG. 1 the air flow is indicated in dotted lines and the seed flow is indicated in full lines. The entire movement of air and some seed movement through the process are powered by the suction fan 77.

It will be seen that the seeds joined by air drawn in and heated at 68 pass up through heater chamber 67 into the cyclone separator 70. While ambient air may be drawn into heater 68, as shown by conduit 81 the suction side of hood 27 of the flame treatment apparatus is preferably connected to the air input side of heater 68. This ensures first that the suction from fan 77 is effective to draw air up through the flame treatment device, and secondly that at least some of the air entering the dryer system is preheated by the flame treatment device at 23 to advantageously minimize the amount of heat required to be added at 68, or at any successive operation as will appear for example in connection with FIGS. 2 and 2A.

The products of combustion from the flame treatment device and the acid and other fumes are all drawn out through the common suction outlet at 77 and there may be treated or neutralized to avoid ambient air pollution.

Referring to FIGS. 3–8, the stack 25 is of rectangular cross section as shown in FIG. 6, and along the opposite longer sides extend the gas burners 26 aligned with corresponding openings 80 in the stack side wall. Other cross sectional shapes for the stack may be used as desired. Thus the burners when ignited may establish a horizontal curtain of flame F across the entire interior of stack 25. Hinged adjustable dampers 82 are provided over corresponding openings 82' in the stack wall below the gas burners for controlling air admission into the stack.

Above the gas burners 26 the stack including its flared upper end is provided all around with an internal wall 83 providing a continuous annular space 84 all around the stack passage. Space 84 is open at its upper end to hood 27, and a bottom wall 85 (FIG. 8) closes the lower end of space 84. The outer wall of the stack near the lower end of space 84 is provided with at least one elongated opening 86 over which is slidably frictionally mounted an air control shutter 87, as by pins 88 and slots 89 in the shutter. This shutter is shown closed in FIG. 5 and it may be moved upwardly to selectively uncover opening 86 to regulate air passing up space 84. Since space 84 is closed at its lower end above the burners no burned gases enter space 84. The function of space 84 is primarily to provide controlled cooling of the stack.

Hood 27 is connected to conduit 81 whereby suction exerted by fan 77 may draw ambient air up stack 25 in counter-current relation to the descending seed mass and at the same time draw cooling air up through space 84, thereby continually removing products of combustion and at the same time continually cooling the stack walls and controlling the flame treatment conditions.

An adjustable air admission shutter 91 is slidably mounted over an opening 92 in the wall of hood 27 for regulating the exhaust temperature delivered to suction conduit 81.

In order to ensure that the suction exerted through hood 27 is equally and uniformly effective on the rear walls of the stack a manifold 93 (FIG. 7) is secured over a slot 94 in the stack outer wall at the upper end of space 84 and this manifold is connected by a bypass tube 95 to the suction conduit 81 adjacent to its connection hood 27.

In some embodiments the lower end of stack 25 below the burners is laterally apertured and surrounded by a plenum P connected to a source of compressed air S which forces air up the stack during operation in cooperation with or instead of suction applied to conduit 81.

If desired the stack may be laterally apertured above the burners and an air supply plenum such as P connected to supply air under pressure into space 84 for cooling.

The entering seed mass passes through the flame treatment apparatus and first encounters the seed feed roller 26. Advantageously the roller, which extends effectively across and occupies the upper end area of the stack passage, is continually driven by motor assembly 13 and acts to separate and distribute the individual seeds from each other and from loose linters and trash such as branches and leaves so that as the seeds fall in uniform distribution and at uniform speed down the stack passage through the hot gases and flame curtain so that there is optimum surface exposure. As the seed mass falls, loose fibers and combustible trash ignite and are consumed. The linters on the seeds ignite and are at least partially burned off before discharge. Suitable controls (not shown) are provided for regulating the burners 26 to maintain the temperature within the stack at the optimum for proper incineration of the fibers and trash without damage to the falling seeds.

A dual view panel 96 of heat resistant glass is provided in the stack walls for observing action in the stack.

The flame treatment device may be that disclosed and claimed per se in my copending application Ser. No. 957,817 filed Nov. 6, 1978 to which reference may be made for further detail. Other flame treatment devices may be used within the scope of this invention.

In operation the control motor 13 is started for feeding uncleaned seed to conveyor 15, with the adjustable control element 101 of control unit 20 set to establish a desired speed for motor 13 that will result in flow of seed through bin outlet 14 at a desired weight rate. The weight rate of feed of the seed from the bin will stabilize under control of a signal transmitted by the weighing system 16–19.

In this respect control 20 may be of the type that in respone to movement of arm 19 sends along line 102 a low pressure signal to a pressure responsive variable resistance device or the like 103 in circuit with a regulator 104 for motor 13, with the result that when the weighing system at 16–19 indicates that the desired feed weight rate has been achieved the speed of motor 13 will become constant. This steady condition of motor 13 will be maintained unless or until a change occurs in the weight rate and is detected by the weighing system which then actuates the control unit to speed up or slow down motor 13 to restore the weight rate of feed at the present level. The foregoing is disclosed in the Downing patent to which reference is made for further necessary detail.

As pointed out heretofore for most conditions this control of the weight rate of feed of the cottonseed in association with the manual settings of flow rates of sulfuric acid and the foaming agent is usually sufficiently accurate for maintained efficient operation.

However it may be desired to more closely correlate even small changes in the weight rate of feed of the seed to the flow rates of acid and foaming agent. To accomplish this a signal such as a voltage signal is sent from control unit 20 along a line 105 to a voltage comparator 106 wherein it is compared to a steady voltage set by an adjustment at 107, and the resultant output transmitted by line 108 to responsive means in both valve control device 47 and valve control device 52, and optionally to the water control at 50 whereby should a change in weight rate feed take place there will be corresponding proportionate changes in the flow rates of the sulfuric acid, water and the foaming agent.

In instances where the acid is of high concentration and/or the linters on the seed may even be of very low moisture content, thus involving only a minimum of water in the treatment, the drying apparatus may be further simplified.

Figure 2:
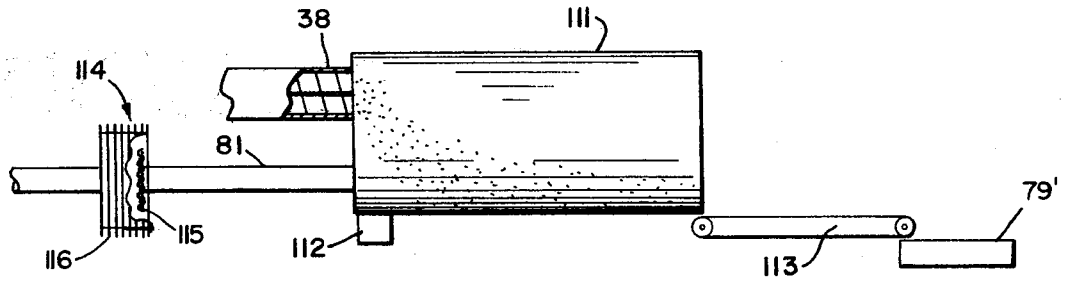
FIG. 2 is a fragmentary view showing simplified drying that may be used in the apparatus of FIG. 1.

As shown in the embodiment of FIG. 2, the wet seed from trough 38 may be continually delivered into a unitary drying and buffing device which may be a rotating hollow drum 111. Heat for drying may be provided by connecting exhaust conduit 81 to introduce the hot air and gases directly into contact with the seed. As shown in FIG. 2, the drum is rotated about a generally horizontal axis as by a motor driven unit 112. The seed is dried and lint is removed by the buffing or scrubbing action due to the seeds rubbing against each other and/or the drum walls. The seed moves out of the exit end of the drum onto a conveyor 113 that delivers it to the neutralizer 79' directly. Preferably conduit 81 is provided with an air to air heat exchange unit 114 whereby burning trash may be prevented from entering heater unit 68 or the drum 111. As shown in FIG. 2 this unit may contain an internal screen 115 and a bottom door 116 that can be opened for cleanout.

Figure 2A:
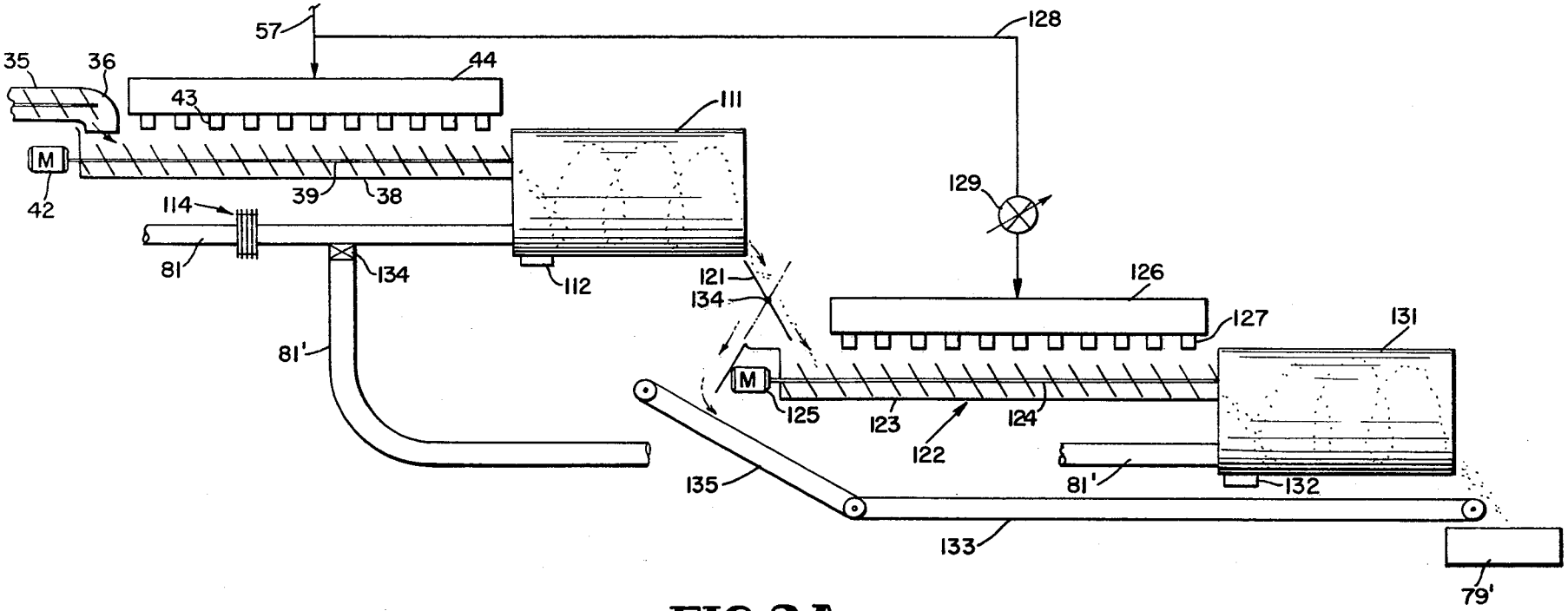
FIG. 2A is a further mainly diagrammatic view showing the invention in a preferred two stage embodiment.
Figures 3, 4, 5:
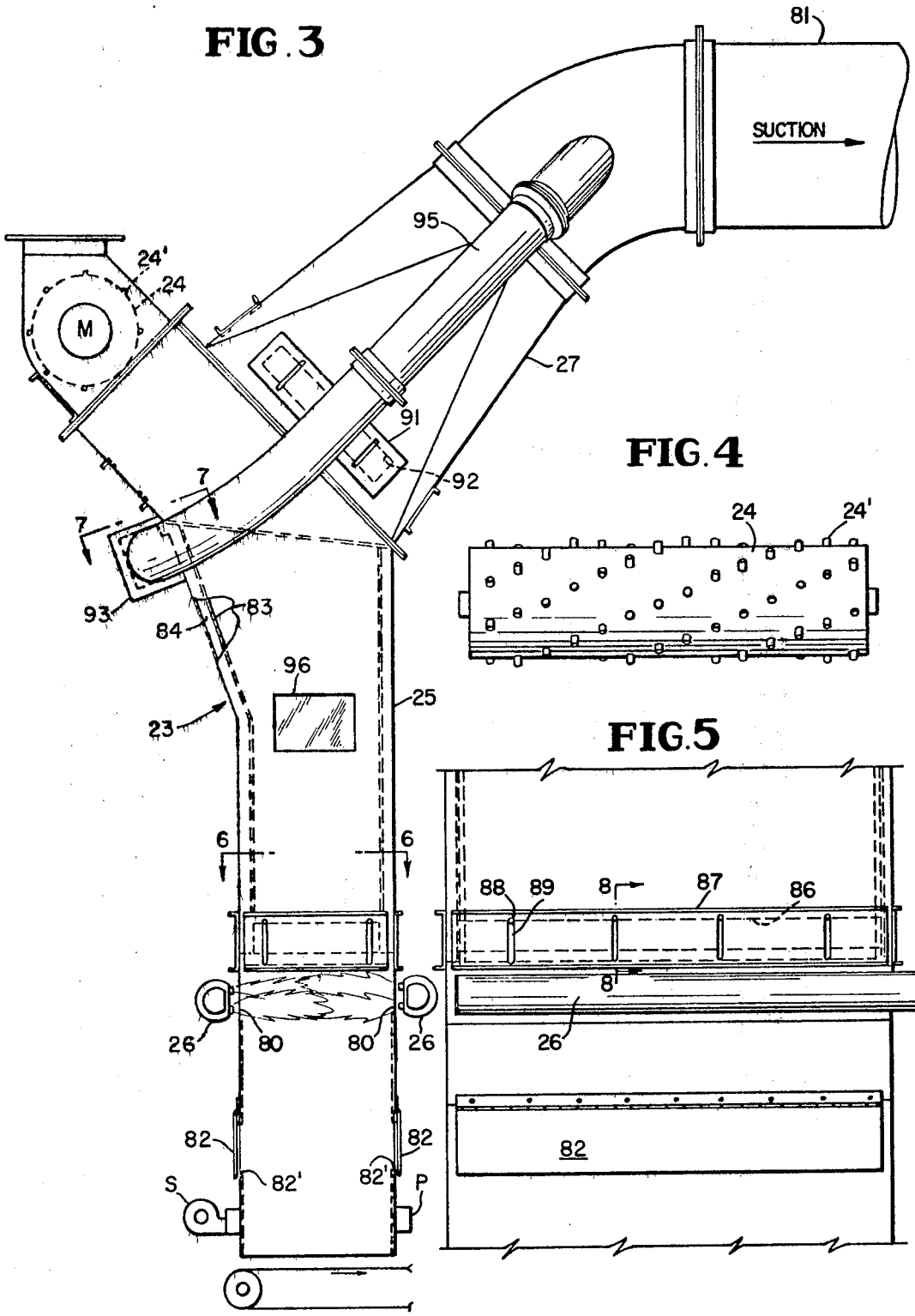
FIG. 3 is an enlarged side view showing detail of the apparatus for flame treatment of the seed during precleaning.
FIG. 4 is an elevation showing a form of toothed roller in the entrance of the flame treatment apparatus.
FIG. 5 is a fragmentary side elevation showing burner and air shutter locations in the flame treatment apparatus.

FIG. 2A illustrates a two stage embodiment which is preferable in practice.

The system may be the same as in FIG. 1 for delivering a continuous supply of precleaned cottonseed to be conveyed along trough 38, and may be the same partly thereafter like FIG. 2 in that the acid treated seed is delivered by trough 38 into the rotating drum 111 into which hot drying air is forced through conduit 81.

In FIG. 2A however a further treatment stage is added in that dried seed discharged from drum 111 may be deflected by plate 121 into a second conveyor-agitator 122 wherein the seed is moved along a grough 123 by an agitating worm 124 driven by a motor 125.

Above trough 123 is disposed a manifold 126 having discharge nozzles 127 distributed along the trough. A branch inlet conduit 128 connects foamed acid supply conduit 57 with manifold 126 through a variable opening valve 129. Thus when valve 129 is open, foamed acid is supplied along the moving agitated seed bed as in trough 38. The amount of foamed acid deposited on the seed can be regulated by valve 129.

At its discharge end conveyor-agitator 122 delivers the seed into a rotating drum drying and buffing device 131 driven by a unit 132 and similar to drum 111. After passing through drum 13 the seed is discharged onto an endless conveyor belt 133 that delivers it to the neutralizer 79'.

Hot drying air is supplied to drum 131 as by a branch conduit 81' having a valve 134 at its juncture with conduit 81, so that when valve 134 is open heated drying air is supplied into both drums.

Thus in the two stage phase of operation precleaned seed is acid treated at 38, buffer-dried at 111, further acid treated at 122 into which is deflected by plate 121 and then buffer-dried at 131 prior to neutralization and final handling. This mode of operation has proved surprisingly efficient for example in that the first seed need only be partially delinted and therefore may be accelerated, and the seed mass is more completely delinted in the second stage.

Little or no more acid is required for the two stages, and this can be set in the controls above described. The relative amounts of acid disposed in the two stages can be controlled by valve 129, as usualy less acid is required in the second stage.

In some instances, as where only partially delinted seed is required. The second stage of FIG. 2A may be bypassed. Plate 121 is pivoted at 134, so that it may be turned from its two stage solid line position to the single stage dotted line position wherein it deflects the dried seed discharged from drum 111 onto a conveyor 135 descending to conveyor 133 whereby it is discharged directly to the neutralizer and final handling. Valves 129 and 134 may be closed in this single stage phase of operation.

In the invention the precleaning operation preconditions the cottonseed for optimum efficiency of the acid treatment. By using foamed sulfuric acid of as high concentration as possible less acid is required, thereby reducing danger of injuring seed as well as expense and possible eventual air pollution, and less water is involved, which reduces the time and energy required for drying the seed, an important further expense reduction, and the acid delinting operation is more efficient in that the foam is uniformly distributed throughout the seed so that by the time it breaks down to free the liquid sulfuric acid uniform degradation of linters takes place rapidly through the entire seed mass. By precleaning efficiently the condition for acid treatment is improved. The foregoing improvements all contribute to a markedly improved and efficient acid delinting process and apparatus that is faster, more efficient and considerably less expensive than in the prior art.

The invention in some components may take various forms. For example instead of depositing the foam during agitation of the seed, the foam may be deposited upon the seed prior to agitation. This may be done in one embodiment by spreading the precleaned seed in a layer or layers on a moving conveyor belt and depositing the foam on the moving seed, and then discharging the seed and foam together into agitating means for uniform distribution.

In another arrangement a preferred plate may be deposited above the agitator trough, or the moving belt carrying the seeds, and a mixture of acid and foaming agent dripped onto the upper surface of the plate while a stream of low pressure air is blown across that surface. This produces foam that continually discharges down through the plate to deposit on the seed.

In some instances the acid and foaming agent and water, if needed, may be premixed in a tank, and the mixture supplied directly to the foaming device 55.

Water may also be added as by spraying it on agitated seed either before or after the acid foam has been deposited to the seed, for aiding foam distribution.

The invention may be embodied in other specific forms without departing from the spirit or essential characteristics thereof. The present embodiments are therefore to be considered in all respects as illustrative and not restrictive, the scope of the invention being indicated by the appended claims rather than by the foregoing description, and all changes which come within the meaning and range of equivalency of the claims and therefore intended to be embraced therein.

What is claimed and desired to be secured by Letters Patent is:

1. Apparatus for the delinting of cottonseed comprising means for providing a continually moving mass of cottonseed to be delinted, controlled means for generating foamed sulfuric acid in operative concentration and depositing said foamed sulfuric acid in said mass of seed while agitating the seed for distributing the foam throughout the seed mass comprising means for continually supplying and admixing proportionate quantities of sulfuric acid and a foaming agent to form a mixture, a foaming device into which said mixture is introduced and converted into foam, and means for conveying the foam to discharge opening means along the moving cottonseed mass, said foaming agent being supplied in sufficient amount to convert substantially all of the mixture to foam, and said acid being present in the foam in sufficient amount for complete degradation of the linters and containing sufficient water to ensure complete wetting and saturation of the linters, and means for passing the seed through an operatively associated dryer-buffer system for lint removal.

2. The apparatus defined as claim 1, wherein said mass is a longitudinally moving substantially uniform cross section bed of said seed, said foamed acid is deposited substantially uniformly along a predetermined length of said bed, and said bed is agitated all along said predetermined length.

3. The apparatus defined in claim 1, wherein adjustable means is provided for selectively individually setting proportionate amounts of said sulfuric acid and said foaming agent for mixing.

4. The apparatus defined in claim 1, wherein means is provided whereby air or a like gas under pressure is introduced into the mixture to assist foaming in said device.

5. The apparatus defined in claim 1, wherein means is provided for continually mixing proportioned quantities of water with the acid and foaming agent prior to foaming.

6. The apparatus defined in claim 1, wherein means is provided for precleaning said seed before deposit of said foamed acid, said precleaning means comprising means for passing said seed to be cleaned through a flame zone wherein at least some of the linters are ignited and burned.

7. The apparatus defined in claim 6, wherein air is moved through said flame zone countercurrent to seed movement for removing products of combustion.

8. The apparatus defined in claim 7, wherein said air moved through the precleaning flame zone is thereby heated and means is provided for conveying said heated air into said drying/buffer system.

9. The apparatus defined in claim 1, wherein said means for drying the seed comprises duct means for conveying a stream of heated air for transporting the seed through first and second cyclone separators, said duct means having an air reheat chamber between the upper end of the first cyclone separator and the lower end of said first cyclone separator where the seeds rejoin the reheated air stream.

10. In the apparatus defined in claim 1, precleaning means comprising means defining a flame zone through which the seeds to be cleaned pass prior to said acid treatment, and means for supplying preheated air to said drying means comprising means for withdrawing heated air from said precleaning means and delivering it to said drying means.

* * * * *